US010415886B2

(12) United States Patent
Choi

(10) Patent No.: US 10,415,886 B2
(45) Date of Patent: Sep. 17, 2019

(54) HEAT EXCHANGER FIXING STRUCTURE OF AIR CONDITIONER

(71) Applicant: SAMSUNG ELECTRONICS CO., LTD., Suwon-si, Gyeonggi-do (KR)

(72) Inventor: Kwang-ho Choi, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 83 days.

(21) Appl. No.: 15/399,248

(22) Filed: Jan. 5, 2017

(65) Prior Publication Data

US 2017/0219292 A1 Aug. 3, 2017

(30) Foreign Application Priority Data

Jan. 28, 2016 (KR) ..... 10-2016-0010600

(51) Int. Cl.

| | |
|---|---|
| ***F28D 1/00*** | (2006.01) |
| ***F28D 1/04*** | (2006.01) |
| ***F28F 9/00*** | (2006.01) |
| ***F28D 1/047*** | (2006.01) |
| ***F28F 9/02*** | (2006.01) |
| *F24F 1/18* | (2011.01) |
| *F28D 1/02* | (2006.01) |

(52) U.S. Cl.

CPC ..... *F28D 1/0435* (2013.01); *F28D 1/047* (2013.01); *F28F 9/001* (2013.01); *F28F 9/002* (2013.01); *F28F 9/0221* (2013.01); *F24F 1/18* (2013.01); *F28D 2001/0273* (2013.01); *F28F 2009/004* (2013.01); *F28F 2275/20* (2013.01)

(58) Field of Classification Search

CPC ..... F28D 1/0435; F28D 1/047; F28D 2001/0273; F28F 9/0221; F28F 1/18; F28F 2275/20

See application file for complete search history.

(56) References Cited

U.S. PATENT DOCUMENTS 2,980,404 A * 4/1961 Andersen ..... F28F 9/0132 165/162
5,267,610 A * 12/1993 Culbert ..... B21D 53/085 165/151
7,013,961 B2 3/2006 Song et al.
(Continued)

FOREIGN PATENT DOCUMENTS

CN 1033898 1/1997
CN 1629596 6/2005
(Continued)

OTHER PUBLICATIONS

Extended European Search Report dated Jul. 4, 2017 in corresponding European Patent Application No. 17150277.6.
(Continued)

*Primary Examiner* — Travis C Ruby
(74) *Attorney, Agent, or Firm* — Staas & Halsey LLP

(57) ABSTRACT

A heat exchanger fixing structure, for two or more heat exchangers bent in multiple layers, includes two or more plates respectively fixed to one ends of the two or more heat exchangers, wherein portions of the two or more plates may overlap each other, and the two or more heat exchangers are connected and fixed to each other by fastening a fastening member to the overlapping portions.

12 Claims, 10 Drawing Sheets

(56) References Cited

U.S. PATENT DOCUMENTS

| | | | | |
|---|---|---|---|---|
| 8,978,409 | B2 * | 3/2015 | Jin | F28D 1/0475 62/498 |
| 9,618,229 | B2 | 4/2017 | Shiborino | |
| 2005/0133209 | A1 | 6/2005 | Song et al. | |
| 2013/0037239 | A1 * | 2/2013 | Shiborino | F24F 1/16 165/67 |

FOREIGN PATENT DOCUMENTS

| | | |
|---|---|---|
| CN | 102834675 | 12/2012 |
| CN | 103765150 | 4/2014 |
| EP | 0597801 | 5/1994 |
| JP | 11-351789 | 12/1999 |
| JP | 2002-206773 | 7/2002 |
| JP | 3966750 | 10/2003 |
| KR | 20-0158976 | 3/1999 |
| KR | 2000-0010142 | 6/2000 |
| KR | 2003-0000208 | 1/2003 |
| KR | 10-2005-0074115 | 7/2005 |
| WO | 2013/084397 A1 | 6/2013 |

OTHER PUBLICATIONS

Chinese Office dated Feb. 3, 2019 in Chinese Patent Application No. 201710054253.0.

European Communication dated Aug. 1, 2019 in European Patent Application No. 17150277.6.

* cited by examiner

HEAT EXCHANGER FIXING STRUCTURE OF AIR CONDITIONER

CROSS-REFERENCE TO RELATED APPLICATIONS

This application claims foreign priority from Korean Patent Application No. 10-2016-0010600, filed on Jan. 28, 2016, in the Korean Intellectual Property Office, the disclosure of which is incorporated herein by reference in its entirety.

BACKGROUND

1. Field

Apparatuses and methods consistent with the present disclosure relate to a heat exchanger fixing structure of an air conditioner, and more particularly, to a heat exchanger fixing structure of an air conditioner capable of fixing a plurality of heat exchangers without using a separate bracket.

2. Description of Related Art

An air conditioner is a device for regulating temperature, humidity, and the like, using a refrigerating cycle appropriately for human beings' activities and removing dust, or the like, in the air. The air conditioner includes an evaporator evaporating a refrigerant to cool the surrounding atmosphere, a compressor compressing a gaseous refrigerant emanated from the evaporator to a high temperature high pressure state, a condenser condensing the gaseous refrigerant compressed by the compressor to a liquid state at room temperature, an expansion valve decompresses the high pressure refrigerant in a liquid state emanated from the condenser, and the like.

Air conditioners may be classified as a separation-type air conditioner and an integration-type air conditioner. The separation-type air conditioner includes an indoor unit installed in an indoor area to suck indoor air to heat-exchange it with a refrigerant and discharge heat-exchanged air to the indoor area and an outdoor unit heat-exchanging a refrigerant introduced from the indoor unit with ambient air such that the refrigerant can be heat-exchanged with indoor air again, and supplying the refrigerant to the indoor unit. In general, a compressor and a condenser are installed in the outdoor unit, and a control box including an electric/electronic component controlling the outdoor unit is provided within the outdoor unit. The expansion valve may be provided in either the indoor unit or the outdoor unit, and the evaporator is positioned in the indoor unit. A heat exchanger in which heat transmission is performed refers to the condenser and the evaporator.

The heat exchanger is generally manufactured to have a plate shape. In order to increase a heat transmission area, a plurality of plate-shaped heat exchangers are provided to overlap each other in multiple layers.

The heat exchangers overlapping each other (or superimposed on each other) in multiple layers are installed in the indoor unit or the outdoor unit. The heat exchangers have a shape of an elongated rectangular plate to increase a heat transfer area. In order to install the elongated rectangular plate-shaped heat exchanger in the indoor unit or the outdoor unit, one end of the heat exchanger is bent.

The heat exchangers superimposed in multiple layers with one end bent may be damaged when moved unless appropriately fixed. Also, when the heat exchangers are actuated, vibration and noise may be generated between the heat exchangers due to a collision and interference therebetween.

In order to prevent this, in the related art, the plurality of heat exchangers in the multiple layers are fixed using a fixing bracket provided on a side surface of the bent end portion of each of the heat exchangers. However, since addition of such a separate component increases material cost and time for an operation required for aligning the fixing bracket and the end portions of the heat exchangers is lengthened to degrade production efficiency.

Thus, a method for rapidly fixing the side surface of the bent end portion of the heat exchanger without adding a separate component is urgently required.

SUMMARY

Exemplary embodiments of the present disclosure overcome the above disadvantages and other disadvantages not described above. Also, the present disclosure is not required to overcome the disadvantages described above, and an exemplary embodiment of the present disclosure may not overcome any of the problems described above.

The present disclosure provides a heat exchanger fixing structure capable of effectively fixing a heat exchanger without a separate fixing bracket.

According to an aspect of the present disclosure, a heat exchanger fixing structure includes: two or more heat exchangers bent in multiple layers; and two or more plates respectively fixed to one ends of the two or more heat exchangers, wherein portions of the two or more plates overlap each other, and the two or more heat exchangers are connected and fixed to each other by fastening a fastening member to the overlapping portions.

The two or more heat exchangers may be first to third heat exchangers, and the two or more plates may be first to third plates respectively corresponding to the first to third heat exchangers.

A plurality of through holes allowing hair pin pipes installed in the first to third heat exchangers to be inserted therethrough may be formed in each of the first to third plates.

The first plate may include: a first base disposed in an end portion of the first heat exchanger; and a first stopper integrally formed in the first base and overlapping the second plate to be fixed to the second plate and the second heat exchanger by a fastening member.

The first stopper may include a first convex portion and a first concave portion provided in positions not interfered with by a hair pin pipe of the first heat exchanger.

A first screw fastening hole may be provided in the first convex portion.

The first convex portion and the first concave portion may be provided in plurality alternately and a hair pin pipe may be disposed in each of the plurality of first concave portions.

The first concave portion may have a circular shape, and a diameter of the first concave portion may be greater than a diameter of the hair pin pipe.

The first convex portion including the first screw fastening hole may be disposed in outermost ones of the plurality of first convex portions formed in a longitudinal direction of the first plate.

The second plate may include: a second base disposed in an end portion of the second heat exchanger; and a second stopper integrally formed in the second base and overlapping the third plate to be fixed to the third plate and the third heat exchanger by a fastening member, the second stopper may include a second convex portion and a second concave portion provided in positions not interfered with by a hair pin pipe of the second heat exchanger, and a second screw fastening hole may be provided in the second convex portion of the second stopper and a third screw fastening hole may be provided in the second base.

The fastening member may be fastened through the first screw fastening hole provided in the first convex portion of the first plate and the third screw fastening hole provided in the second base of the second plate.

The third plate may include a third base disposed in an end portion of the third heat exchanger, and a fourth screw fastening hole may be provided in the third base.

The fastening member may be fastened through the second screw fastening hole provided in the second convex portion of the second plate and the fourth screw fastening hole provided in the third base of the third plate.

The plurality of through holes may have a circular shape or a long hole shape.

BRIEF DESCRIPTION OF THE DRAWING FIGURES

The above and/or other aspects of the present disclosure will be more apparent by describing certain exemplary embodiments of the present disclosure with reference to the accompanying drawings, in which.

DESCRIPTION OF EMBODIMENTS

Figure 1:
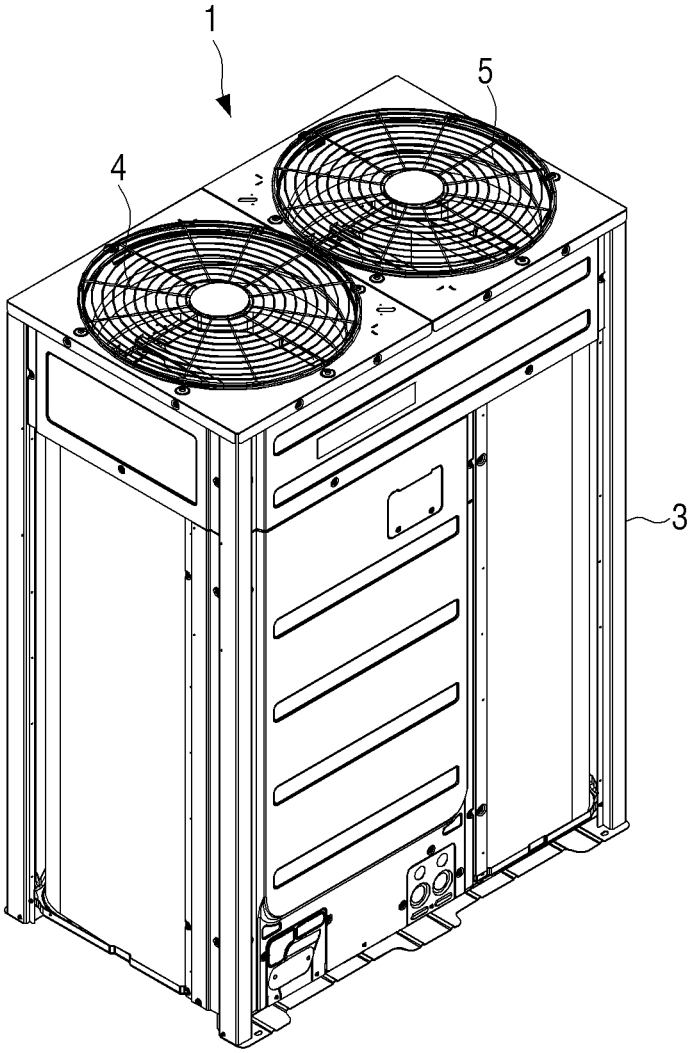
FIG. 1 is a perspective view of an air conditioner according to an exemplary embodiment of the present disclosure.

Hereinafter, various example embodiments of the disclosure will be described with reference to the accompanying drawings. However, it should be understood that there is no intent to limit the disclosure to the particular forms disclosed herein; rather, the disclosure should be construed to cover various modifications, equivalents, and/or alternatives of the various example embodiments of the disclosure. In describing the drawings, similar reference numerals may be used to designate similar constituent elements.

The expression "a first", "a second", "the first", or "the second" used in various example embodiments of the disclosure may modify various components regardless of their order and/or the importance but does not limit the corresponding components. For example, a first user device and a second user device indicate different user devices although both of them are user devices. For example, a first element may be termed a second element, and similarly, a second element may be termed a first element without departing from the scope of the disclosure.

The terms used herein are merely for the purpose of describing example embodiments and are not intended to limit the scope of other embodiments. As used herein, singular forms may include plural forms as well unless the context clearly indicates otherwise. Unless defined otherwise, all terms used herein, including technical and scientific terms, have the same meaning as those commonly understood by a person skilled in the art to which the present disclosure pertains. Such terms as those defined in a generally used dictionary may be interpreted to have the meanings equal to the contextual meanings in the relevant field of art, and are not to be interpreted to have ideal or excessively formal meanings unless clearly defined in the disclosure. In some cases, even the term defined in the disclosure should not be interpreted to exclude embodiments of the disclosure.

Figure 2:
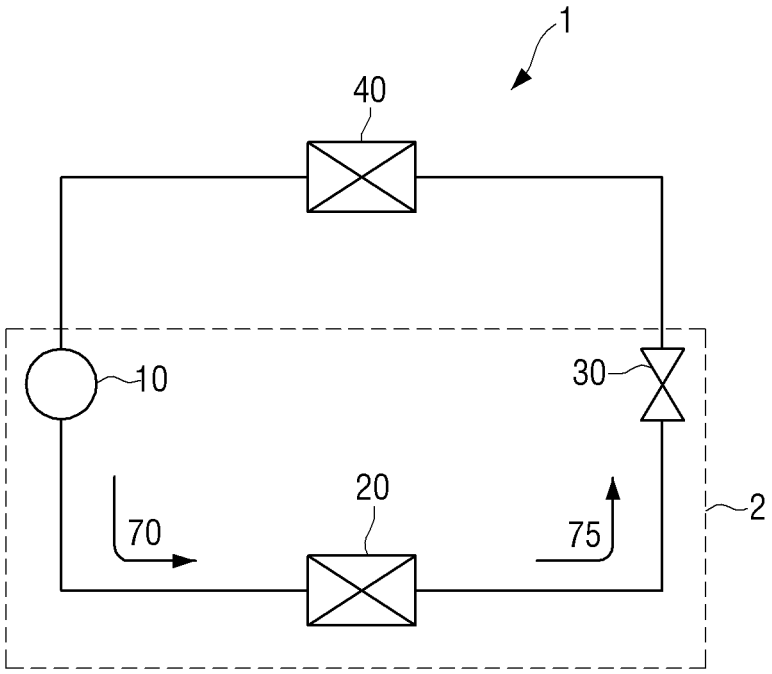
FIG. 2 is a view illustrating a refrigerating cycle of an air conditioner according to an exemplary embodiment of the present disclosure.

FIG. 1 is a perspective view of an air conditioner according to an embodiment of the present disclosure, and FIG. 2 is a view illustrating a refrigerating cycle of an air conditioner according to an embodiment of the present disclosure. An air conditioner 1 illustrated in FIG. 1 may refer to an outdoor unit or an indoor unit.

Referring to FIG. 1, the air conditioner 1 includes a case 3 forming an appearance thereof. A compressor 10, a condenser 20, an expansion valve 30, and an evaporator 40 constituting a refrigerating cycle illustrated in FIG. 2 are disposed inside the case 3. Also, a plurality of cooling fans 4 and 5 may be installed in the case 3.

Referring to FIG. 2, the refrigerating cycle forming the air conditioner 1 includes the compressor 10, the condenser 20, the expansion valve 30, and the evaporator 40. The refrigerating cycle performs sequential processes including compression, condensation, expansion, and evaporation, and after high temperature air is heat-exchanged with a low temperature refrigerant, the low temperature compressor 10 compresses a refrigerant gas 70 to discharge a high temperature and high pressure refrigerant gas 70, and the discharged refrigerant gas 70 is introduced to the condenser 20. The condenser 20 condenses the compressed refrigerant to a high temperature and high pressure liquid phase refrigerant 75. The expansion valve 30 expands the condensed liquid phase refrigerant 75 in a high temperature and high pressure state from the condenser 20 to a liquid phase refrigerant in a low pressure state. The evaporator 40 evaporates the expanded refrigerant from the expansion valve 30. The evaporator 40 achieves a refrigeration effect through heat-exchange with an object to be cooled using latent heat of vaporization of the refrigerant, and returns the refrigerant gas in a low temperature and low pressure state to the compressor 10. Through this cycle, air-conditioned air may be supplied to an indoor area.

The outdoor unit 2 of the air conditioner 1 may include the compressor 10 and the condenser 30 of the refrigerating cycle. The expansion valve 30 may be installed in either the indoor unit or the outdoor unit 2, and the evaporator 40 is positioned in the indoor unit. That is, the heat exchanger refers to the condenser 20 and the evaporator 40 in which heat is exchanged. Hereinafter, for the purposes of description, the heat exchanger will be denoted by reference numeral different from those of the condenser 20 and the evaporator 40.

Figure 3:
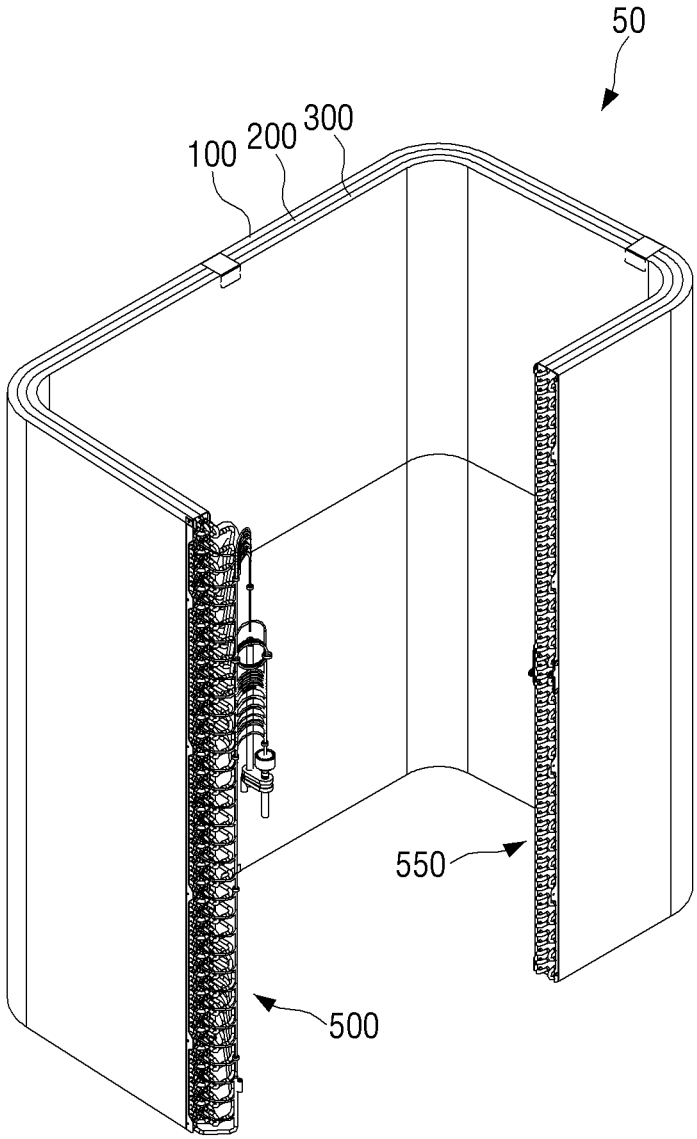
FIG. 3 is a perspective view of a heat exchanger.

FIG. 3 is a perspective view of a heat exchanger applied to the outdoor unit of the air conditioner according to an embodiment of the present disclosure. The heat exchanger 50 illustrated in FIG. 3 may also be applied to the indoor unit (not shown), and here, the heat exchanger 30 may have a predetermined shape that may be installed inside the indoor unit.

In order to increase a heat transfer area, the heat exchanger 50 is formed to have multiple layers by superimposing a plurality of plate-shaped heat exchangers 100, 200, and 300.

As illustrated in FIG. 3, the heat exchanger 50 is bent at multiple stages so as to be installed in the outdoor unit.

Figure 4:
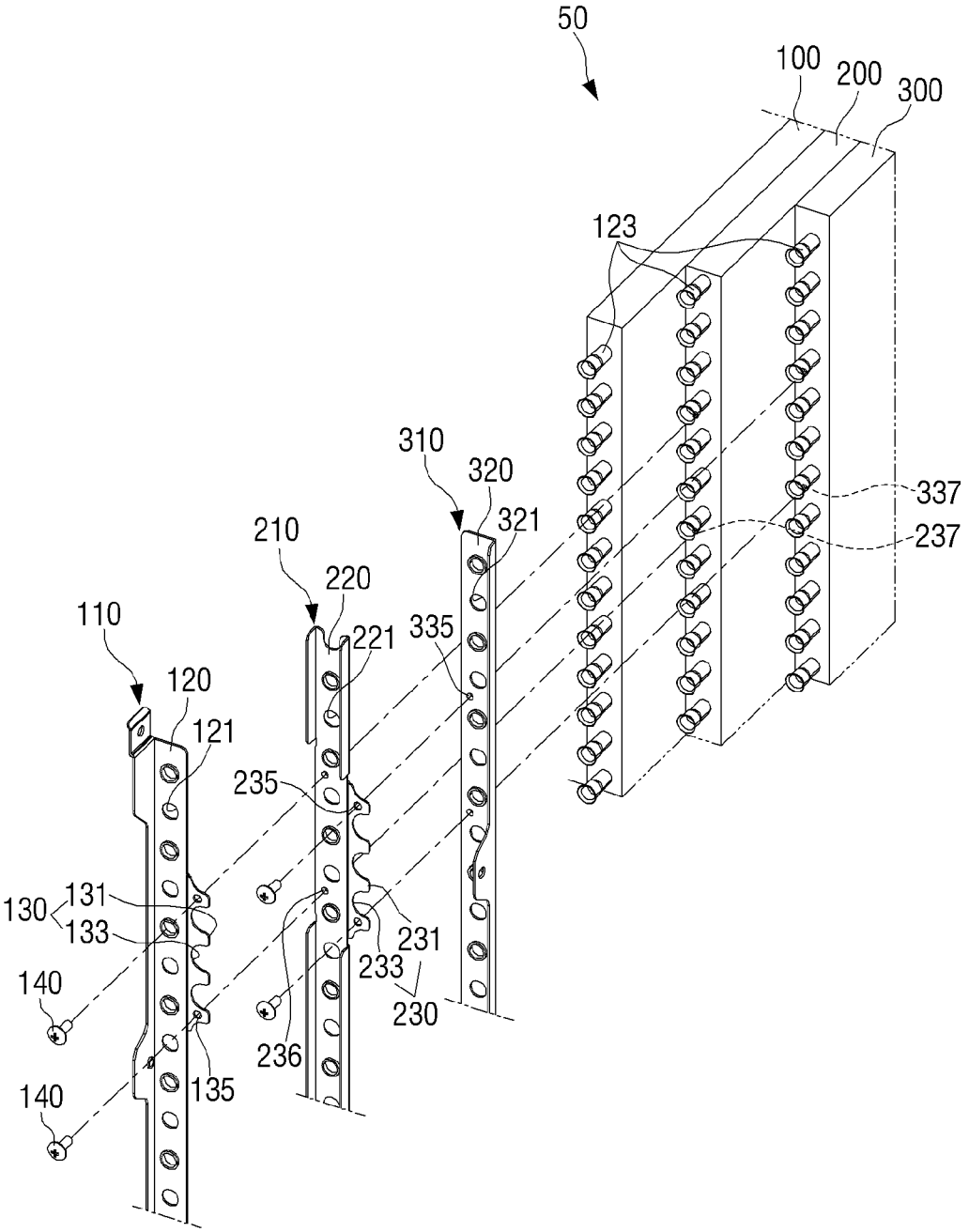
FIG. 4 is an exploded perspective view of a main side coupling structure of a heat exchanger in a flat plate state.
Figure 5:
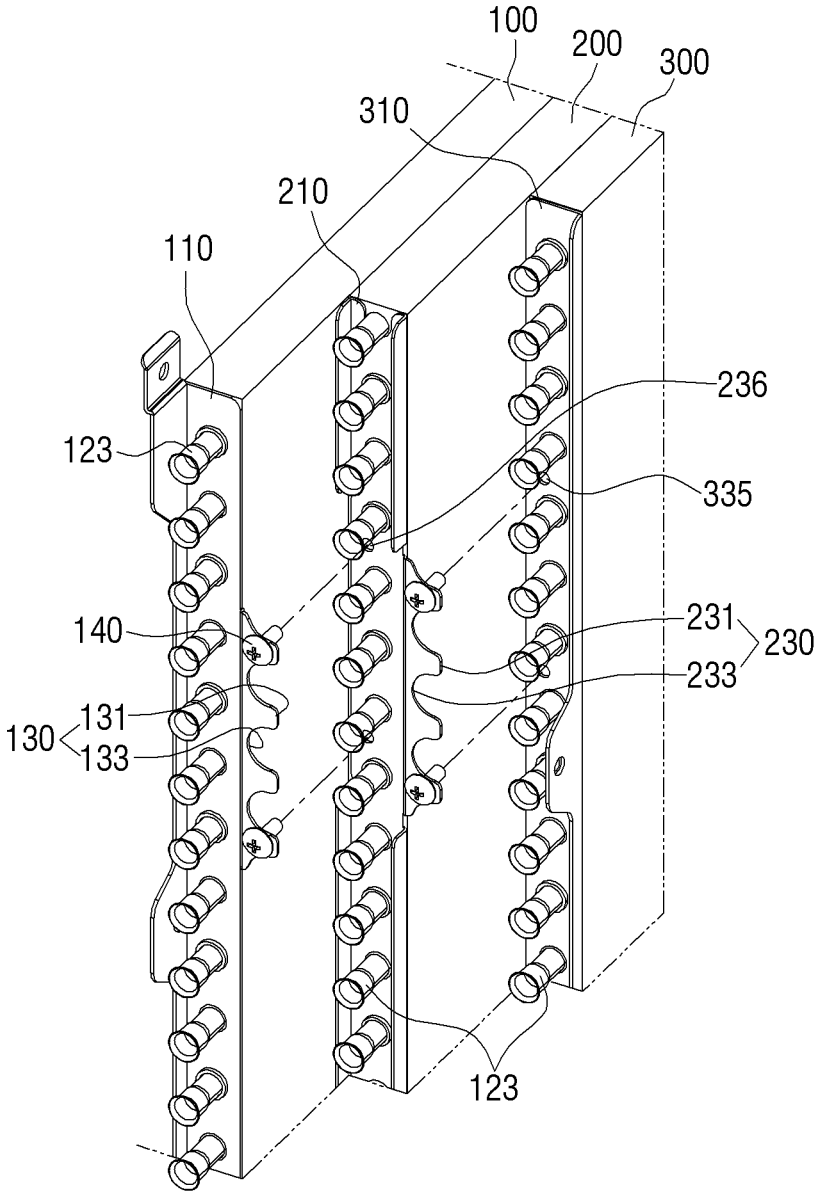
FIG. 5 is a coupling perspective view of a main side coupling structure of a heat exchanger in a flat plate state.
Figure 6:
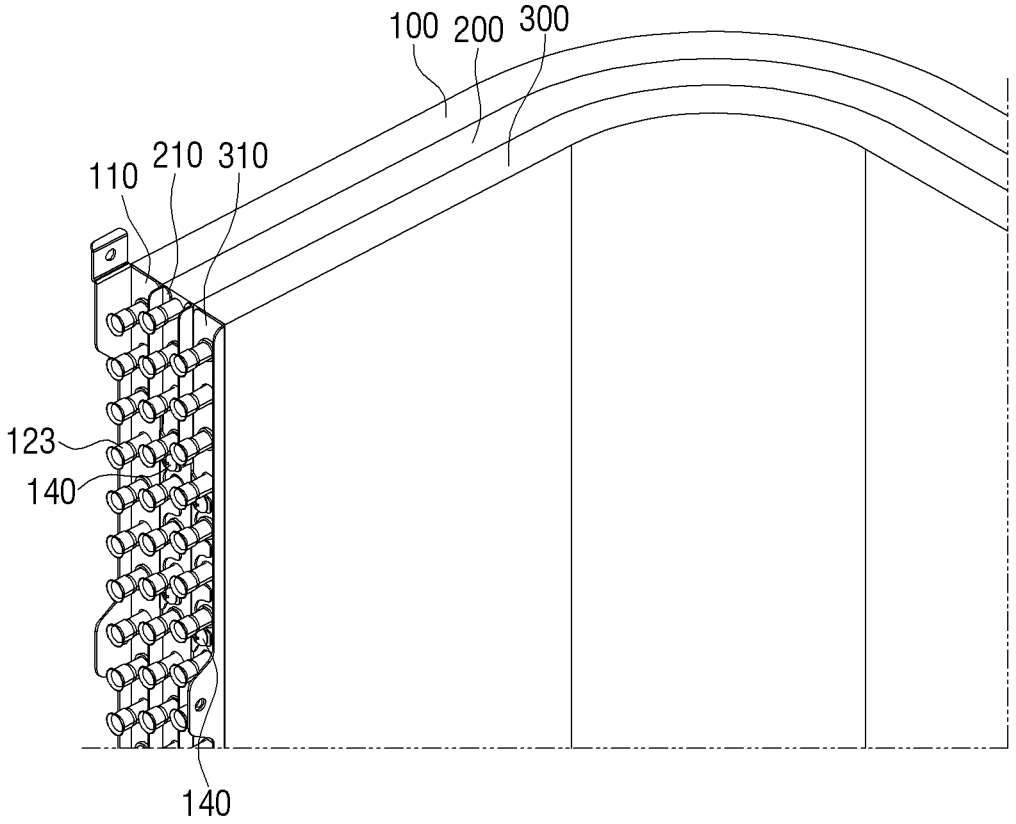
FIG. 6 is a coupling perspective view of a main side coupling structure of a heat exchanger in a bent plate state.

Hair pin pipes 123 in which a refrigerant as a heat transmission medium flows are disposed in a zigzag manner inside the heat exchanger 50. A side of the heat exchanger 50 in which an entrance of the hair pin pipe 123 is open will be defined as a main side 500, and a side of the heat exchanger 50 in which the hair pin pipe 123 is formed as a U-shaped curved pipe 124 (please refer to FIG. 7) will be defined as a sub side 550. Hereinafter, a fixing structure of the heat exchanger according to an embodiment of the present disclosure will be described with reference to FIGS. 4 to 6. FIG. 4 is an exploded perspective view of a main side coupling structure of a heat exchanger in a flat plate state, FIG. 5 is a coupling perspective view of a main side coupling structure of a heat exchanger in a flat plate state, and FIG. 6 is a coupling perspective view of a main side coupling structure of a heat exchanger in a bent plate state. Here, the flat plate state refers to a state before the heat exchanger is bent.

As illustrated in FIG. 4, the heat exchanger 50 includes first to third heat plate-shaped exchangers 100, 200, and 300. The heat exchangers 100, 200, and 300 are different in length. Thus, before being bent, the heat exchangers 100, 200, and 300 in a stacked state are fixed by a predetermined fixing bracket such that the heat exchangers 100, 200, and 300 on the sub side 550 are aligned in the same position without a step. In this case, the heat exchangers 100, 200, and 300 on the main side 500 are aligned to be stepped as illustrated in FIG. 4. That is, the second heat exchanger 200 protrudes, relative to the third heat exchanger 300, and the first heat exchanger 100 protrudes, relative to the second heat exchanger 200. The reason why the heat exchangers 100, 200, and 300 are sequentially arranged to be stepped on the main side 500 is to eliminate generation of a step on the main side 500 as illustrated in FIG. 6 when the heat exchangers 100, 200, and 300 are bent. When a step is generated on the main side 500, it may be difficult to fix end portions of the heat exchangers 100, 200, and 300 and welding may be defective when a refrigerant supply pipe (not shown) is welded to the hair pin pipe 123.

The first to third heat exchangers 100, 200, and 300 include first to third plates 110, 210, and 310, respectively.

The first to third plates 110, 210, and 310 are fixed to end portions of the first to third heat exchangers 100, 200, and 300 through a plurality of screws 140, respectively. Here, when the main side 500 is bent, portions of the first to third plates 110, 210, and 310 are sequentially superimposed. In this manner, the first to third heat exchangers 100, 200, and 300 are integrally fixed by the first to third plates 110, 210, and 310.

As described above, since the plates 110, 210, and 310 are sequentially superimposed and fixed, the plates 110, 210, and 310 may need only handle only a fastening load of the superimposed plate, rather than handling a load for fastening all the plates. Thus, strength required when designing each plate may be lowered. As a result, when the heat exchanger 50 is activated, vibration and noise due to collision and interference between the plurality of heat exchangers in multiple layers may be reduced.

The first, second, and third superimposed plates 110, 210, and 310 may be fixed by a screw, or without being limited thereto, various other fastening methods such as a snap coupling structure, welding, and the like, may also be applied.

The first to third plates 110, 210, and 310 may have different structures. Hereinafter, structures of the first to third plates 110, 210, and 310 will be described in detail.

The first plate 110 includes a first base 120 and a first stopper 130.

The first base 120 is tightly attached to an end portion of the main side 500 of the first heat exchanger 100. A plurality of through holes 121 allowing the hair pin pipes 123 pass therethrough are provided on the first base 120. The first stopper 130 is integrally formed in the first base 110. A related art fixing bracket is provided as a separate member from the plate. Due to this, in order to fasten the fixing bracket and the plate by a fastening member, the fixing bracket and the plate should be aligned in a fastening position, causing inconvenience. In addition, a predetermined alignment time is required for accurate alignment, acting as a main factor of a degradation of production efficiency. In contrast, in an embodiment of the present disclosure, since the first stopper 130 and the first plate 110 are integrally formed, cumbersomeness of alignment is eliminated and an operation time is shortened.

The first stopper 130 includes a first convex portion 131 and a first concave portion 133 alternately formed on one end portion of the first plate 110. Here, the first convex portion 131 and the first concave portion 133 may each be formed in plurality.

With the main side 500 of the heat exchanger 50 bent, the first stopper 130 is superimposed on the second plate 210 and the hair pin pipe 123 of the second plate 210 is disposed in the first concave portion 133. In this manner, the first concave portion 133 serves to prevent the hair pin pipe 123 passing through the second heat exchanger 200 from being interfered by the first stopper 130. The first concave portion 133 may have a substantially circumferential shape and a diameter greater than that of the hair pin pipe 123.

A first screw fastening hole 135 is provided in the first convex portion 131. The first screw fastening hole 135 may be formed in all the plurality of first convex portions 131. However, without being limited thereto, the first screw fastening hole 135 may be provided only in the first convex portions 131 positioned on the outermost sides. This is to maximize a distance between the screw fastening holes 135 to minimize a degradation of strength of the plate due to fastening of the screw 140 and prevent damage to the plate potentially caused by a minimized strength.

The second plate 210 includes a second base 220 and a second stopper 230, like the first plate 210 as mentioned above. The second base 220 is tightly attached to an end portion of the main side 500 of the second heat exchanger 200.

The second stopper 230 is integrally formed in the second base 220. The second stopper 230 includes a second convex portion 231 and a second concave portion 233 alternately formed on one end portion of the second plate 210. Here, the second convex portion 231 and the second concave portion 233 may each be formed in plurality.

With the main side 500 of the heat exchanger 50 bent, the second stopper 230 is superimposed on the third plate 310 and the hair pin pipe 123 of the third plate 310 is disposed in the second concave portion 233. In this manner, the second concave portion 233 serves to prevent the hair pin pipe 123 passing through the third heat exchanger 300 from being interfered by the second stopper 230. The second concave portion 233 may have a substantially circumferential shape and a diameter greater than that of the hair pin pipe 123.

A second screw fastening hole 235 is provided in the second convex portion 231. The second screw fastening hole 235 may be formed in all the plurality of the second convex portions 231. However, without being limited thereto, the second screw fastening hole 235 may be provided only in the second convex portions 231 positioned on the outermost sides. Unlike the first plate 110, in the second plate 210, a third screw fastening hole 236 is provided in the second base 220. The screw 140 may sequentially pass through the first screw fastening hole 135 of the first convex portion 131 and the third screw fastening hole 236 of the second base 220 so as to be fastened to a screw fastening hole (not shown) of an end portion of the second heat exchanger 200. Thus, the second plate 210 may be fixed to the end portion of the second heat exchanger 200 and the first and second plates 110 and 210 are connected to each other.

The third plate 310 includes a third base 320. The third base 320 does not form a stopper, unlike the first and second bases 120 and 220. The third base 320 is tightly attached to an end portion of the main side 500 of the third heat exchanger 300. A fourth screw fastening hole 335 is provided in the third base 320. The screw 140 may sequentially pass through the second screw fastening hole 235 of the second convex portion 231 and the fourth screw fastening hole 335 of the third base 320 so as to be fastened to a screw fastening hole (not shown) formed in an end portion of the third heat exchanger 300. Thus, the third plate 310 may be fixed to the end portion of the third heat exchanger 300 and the second and third plates 210 and 310 are connected to each other.

As described above, the first to third plates 110, 210, and 310 may be fixed to the end portions of the first to third heat exchangers 100, 200, and 300, as well as being connected to each other through the screw 140. Here, the first stopper 130 of the first plate 110 is superimposed on the second base 220 of the second plate 210 and the second stopper 230 of the second plate 210 is superimposed on the third base 320 of the third plate 310.

Thus, the first to third plates 110, 210, and 310 may be stably fixed to the end portions of the first to third heat exchangers 100, 200, and 300, respectively. Thus, the heat exchangers 100, 200, and 300 do not collide with each other or are not be interfered from each other due to vibrations generated when the air conditioner 1 is actuated, suppressing noise generation.

In the above, the example in which the end portions of the heat exchangers 100, 200, and 300 are connected and fixed to the main side 500 of the heat exchanger 50 using the plurality of plates 110, 210, and 310 has been described. Hereinafter, an example in which the end portions of the heat exchangers 100, 200, and 300 are connected and fixed to the sub side 500 of the heat exchanger 50 using the plurality of plates 110, 210, and 310 will be described.

In FIG. 4, reference numerals 237 and 337 each denote a fastening hole to which the screw 140 is fastened.

Figure 7:
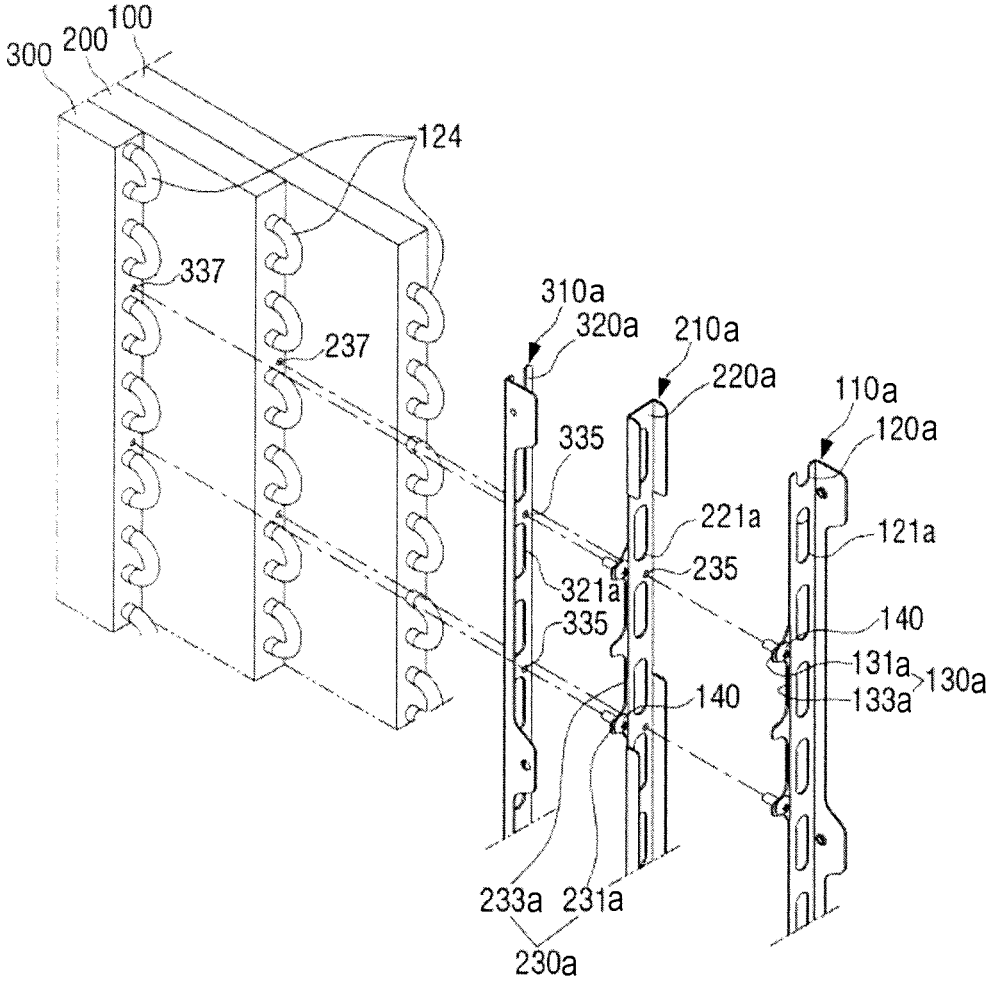
FIG. 7 is an exploded perspective view of a sub side coupling structure of a heat exchanger in a flat plate state.
Figure 8:
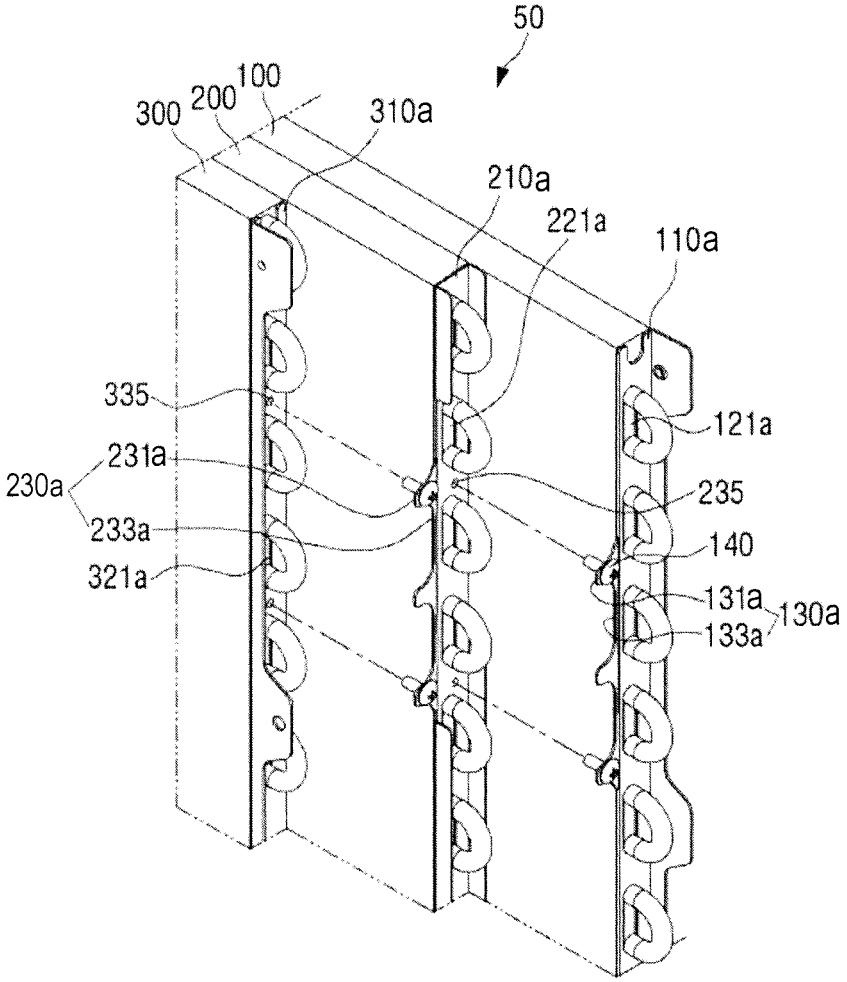
FIG. 8 is a coupling perspective view of a sub side coupling structure of a heat exchanger in a flat plate state.
Figure 9:
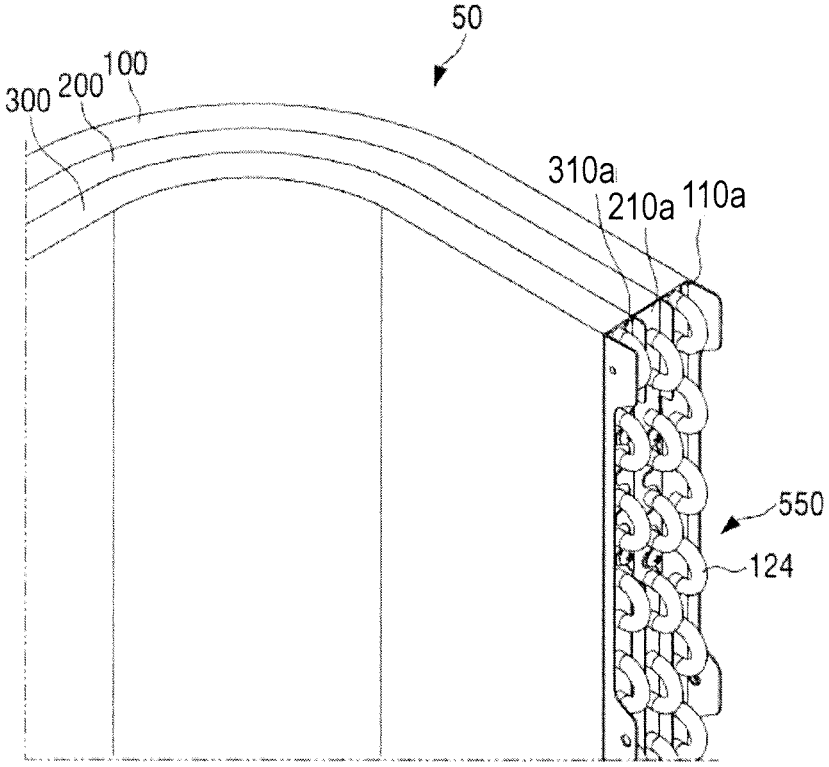
FIG. 9 is a coupling perspective view of a sub side coupling structure of a heat exchanger in a bent plate state.

FIG. 7 is an exploded perspective view of a sub side coupling structure of a heat exchanger in a flat plate state, FIG. 8 is a coupling perspective view of a sub side coupling structure of a heat exchanger in a flat plate state, and FIG. 9 is a coupling perspective view of a sub side coupling structure of a heat exchanger in a bent plate state.

Referring to FIG. 7, a plurality of plates 110*a*, 210*a*, and 310*a* used in the sub side 550 of the heat exchanger 50 are mostly the same in structure, and only shapes of a plurality of through holes 121*a*, 221*a*, and 321*a* through which the U-shaped curved pipes 124 forming part of the hair pin pipes 123 are different. Hereinafter, only the plurality of through holes 121*a*, 221*a*, and 321*a* will be described. The plurality of through holes 121*a*, 221*a*, and 321*a* have a long hole shape allowing the U-shaped curved pipes 124 penetrate therethrough such that the plates 110*a*, 210*a*, and 310*a* are tightly fixed to end portions of the heat exchangers 100, 200, and 300, respectively.

When the plates 110*a*, 210*a*, and 310*a* are fixed to the end portions of the heat exchangers 100, 200, and 300, respectively, the plurality of U-shaped curved pipes 124 may be stably supported by the plurality of through holes 121*a*, 221*a*, and 321*a*.

The first stopper 130*a* formed in the first base 120*a* includes a first convex portion 131*a* and a first concave portion 133*a* alternately formed on one end portion of the first plate 110*a*. Here, the first convex portion 131*a* and the first concave portion 133*a* may each be formed in plurality. The first concave portion 133*a* may have a length not interfering with the U-shaped curved pipe 124.

The second stopper 230*a* formed in the second base 220*a* includes a second convex portion 231*a* and a second concave portion 233*a* alternately formed on one end portion of the second plate 210*a*. Also, the second concave portion 233*a* of the second stopper 230*a* formed in the second base 220*a* may have a length not interfering with the U-shaped curved pipe 124, like the first concave portion 133*a* described above. The third plate 310*a* includes a third base 320*a*.

A process of fixing the plurality of plates 110*a*, 210*a*, and 310*a* used in the sub side 550 of the heat exchanger 50 configured as described above to the first to third heat exchangers 100, 200, and 300 is the same as that of the plurality of plates 110, 210, and 310 used in the sub side 550 of the heat exchanger 50 described above, and thus, descriptions thereof will be omitted.

Figure 10:
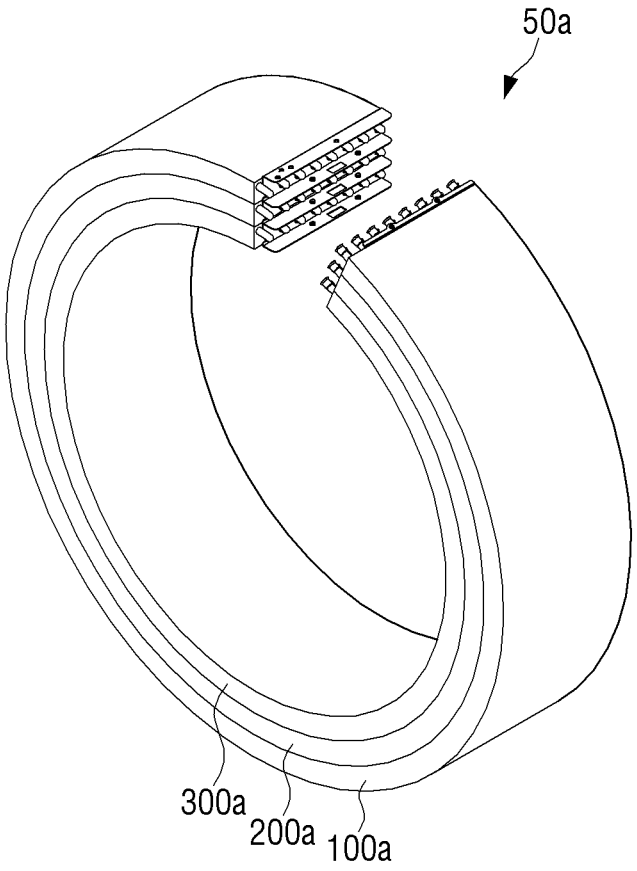
FIG. 10 is a perspective view illustrating a heat exchanger according to another exemplary embodiment of the present disclosure.

In FIG. 10, reference numerals 237 and 337 each denote a fastening hole through which the screw 140 is fastened.

FIG. 10 is a perspective view illustrating a heat exchanger according to another embodiment of the present disclosure.

Referring to FIG. 10, a heat exchanger 50*a* according to another embodiment of the present disclosure mostly has the same components as those of the heat exchanger 50 described above and is different from the heat exchanger 50 in that heat exchangers 100*a*, 200*a*, and 300*a* superimposed on each other are circularly bent to have the same curvature.

The heat exchanger 50*a* may be bent to have a circular shape or may be bent to have an oval shape (not shown).

As described above, according to various embodiments of the present disclosure, in coupling bent end portions of the heat exchangers in multiple layers, the heat exchangers may be fixed rapidly without adding a separate fixing bracket.

Also, the structure for fixing the heat exchanger is integrally formed in the plate finishing the end portion of the heat exchanger, increasing production efficiency.

The heat exchanger according to embodiments of the present disclosure is described such that the three plate-shaped heat exchangers are sequentially superimposed on each other and bent, but the present disclosure is not limited thereto and at least two plate-shaped heat exchangers may be superimposed on each other and bent.

Specific embodiments have been described. However, the present disclosure is not limited to the specific embodiments and various modifications may be made without departing from the scope of the present disclosure claimed in the claims, and such modifications should not be individually understood from technical concepts or prospects of the present disclosure.

What is claimed is:

1. A heat exchanger comprising:

a plurality of heat exchangers layered in a multilayer arrangement; and a plurality of plates respectively fixed to respective ends of the plurality of heat exchangers, wherein portions of two of the plurality of plates overlap each other at overlapping portions, wherein the heat exchangers respectively fixed to the two of the plurality of plates are connected and fixed to each other by fastening a fastening member to the overlapping portions, wherein the overlapping portions are disposed between a plurality of through holes through which a plurality of hair pin pipes pass, respectively, wherein the plurality of heat exchangers include first to third heat exchangers, wherein the plurality of plates include first to third plates corresponding to the first to third heat exchangers, respectively, wherein the first plate includes a first base disposed in an end portion of the first heat exchanger and a first stopper integrally formed with the first base and being overlapped with the second plate, wherein the first stopper includes a plurality of first convex portions relative to an edge of the first base adjacent to the first stopper, and a plurality of first concave portions relative to the edge of the first base adjacent to the first stopper and having a plurality of open sides, respectively, some of the first convex portions including a first fastening hole for a fastening member, wherein a hair pin pipe of the second heat exchanger is disposed in the plurality of the first concave portions using the plurality of open sides of the plurality of first concave portions, and wherein the plurality of the first convex portions and the plurality of the first concave portions are disposed alternately.

2. The heat exchanger as claimed in claim 1, wherein each of the first to third plates has the plurality of through holes allowing hair pin pipes installed in the respective one of the first to third heat exchangers to be inserted therethrough.

3. The heat exchanger as claimed in claim 2, wherein the first stopper is fixed to the second plate and the second heat exchanger by the fastening member.

4. The heat exchanger as claimed in claim 3, wherein the plurality of the first convex portions and the plurality of the first concave portions are provided at positions not interfered with by the hair pin pipe installed in the second heat exchanger.

5. The heat exchanger as claimed in claim 4, wherein the plurality of the first concave portions have an arc shape, and a diameter of the first concave portion is greater than a diameter of the hair pin pipe.

6. The heat exchanger as claimed in claim 2, wherein the plurality of through holes have a circular shape.

7. The heat exchanger as claimed in claim 2, wherein the plurality of through holes have a long hole shape.

8. The heat exchanger as claimed in claim 1, wherein outermost convex portions of the plurality of first convex portions in a longitudinal direction of the first plate each have a fastening hole.

9. The heat exchanger as claimed in claim 1, wherein the fastening member is a first fastening member, the second plate includes:

a second base disposed in an end portion of the second heat exchanger; and a second stopper integrally formed with the second base, overlapping the third plate, and fixed to the third plate and the third heat exchanger by a second fastening member, the second stopper includes a second convex portion and a second concave portion provided, both provided in positions not interfered with by a hair pin pipe installed in the third heat exchanger, a second fastening hole is provided in the second convex portion of the second stopper, and a third fastening hole is provided in the second base.

10. The heat exchanger as claimed in claim 9, wherein the first fastening member is fastened through the first fastening hole provided in the first convex portion of the first plate and through the third fastening hole provided in the second base of the second plate.

11. The heat exchanger as claimed in claim 9, wherein the third plate includes a third base disposed in an end portion of the third heat exchanger, and a fourth fastening hole is provided in the third base.

12. The heat exchanger as claimed in claim 11, wherein the second fastening member is fastened through the second fastening hole provided in the second convex portion of the second plate and through the fourth fastening hole provided in the third base of the third plate.

* * * * *